United States Patent [19]

Wallevik et al.

[11] Patent Number: 4,784,742

[45] Date of Patent: Nov. 15, 1988

[54] CATHODE FOR MAGNESIUM PRODUCTION

[75] Inventors: Oddmund Wallevik; Ole J. Kaasa; Gunnar Endal, all of Porsgrunn, Norway

[73] Assignee: Norsk Hydro a.s., Oslo, Norway

[21] Appl. No.: 934,107

[22] Filed: Nov. 24, 1986

[51] Int. Cl.[4] ..... C25C 3/00

[52] U.S. Cl. ..... 204/243 R; 204/290 R; 204/292; 204/294; 204/268

[58] Field of Search ..... 204/243 R, 290 R, 292–294, 204/70, 39, 268, 67; 427/422, 423

[56] References Cited

U.S. PATENT DOCUMENTS

| | | | |
|---|---|---|---|
| 3,979,267 | 9/1976 | Townsend | 204/39 |
| 4,073,704 | 2/1978 | Beale | 204/70 |
| 4,554,058 | 11/1985 | Lei et al. | 204/109 |
| 4,571,983 | 2/1986 | Sanborn et al. | 427/423 |

OTHER PUBLICATIONS

"Prep. of Thick Coats of W" by McCawley et al, U.S. Bur. Mines, R.I. 6454, 1964.

"Electrovin W...", by Gomes et al, U.S. Bu. Mines R.I. 6742, 1966.

"Effect of - Process Variables on Vapor. Dep. W.", by Hoertel, U.S. Bur. Mines, R.I. 6731, 1966.

*Primary Examiner*—R. L. Andrews

*Attorney, Agent, or Firm*—Wenderoth, Lind & Ponack

[57] ABSTRACT

Cathode for use in magnesium production by electrolysis of molten salts. The cathode consists of compact molybdenum, tungsten or alloys of these metals or consists of a substrate coated with molybdenum, tungsten or alloys of these metals. The thickness of the coating is at least 10–20 μm. The substrate can be iron or carbon. Carbon coated with molybdenum, tungsten or alloys of these metals can be used as the cathodic face of a bipolar electrode. The wetting of the cathode by magnesium is improved and the amount of contaminants in the produced metal is reduced.

9 Claims, 5 Drawing Sheets

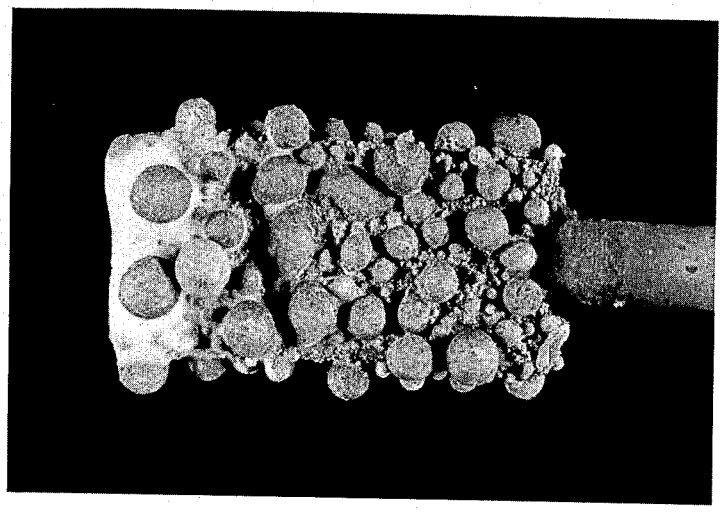
FIG. 1 CATHODE OF UNTREATED STEEL (ST37)
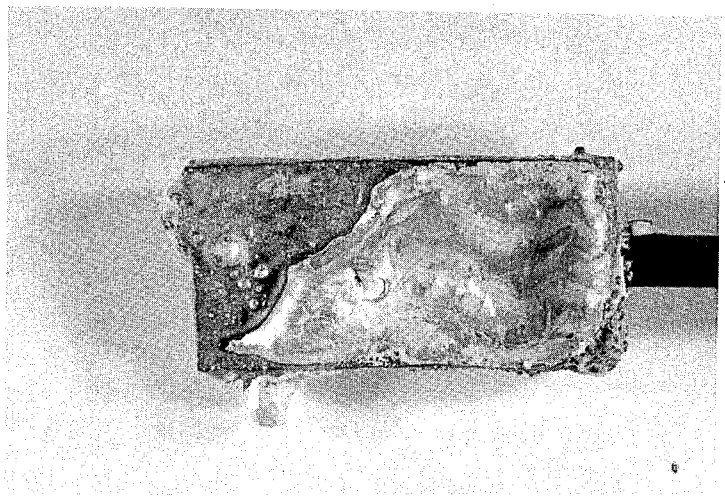
FIG. 2 CATHODE OF UNTREATED SOLID MO

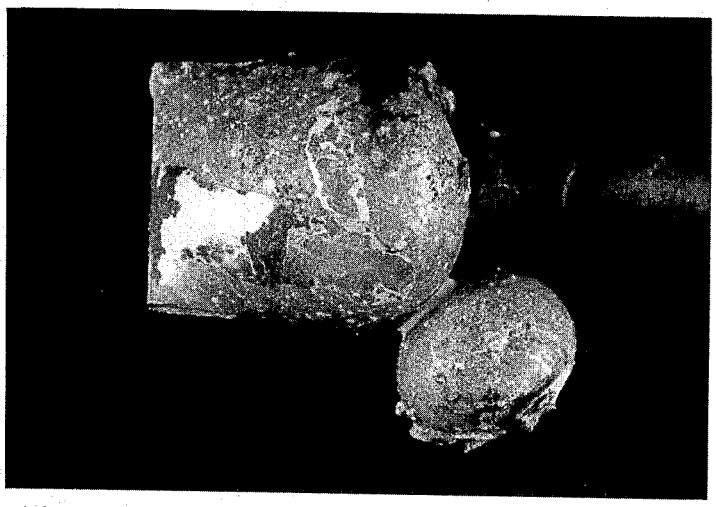
FIG. 3 CATHODE OF STEEL SUBSTRATE WITH MO-COATING - 0.35 mm THICKNESS
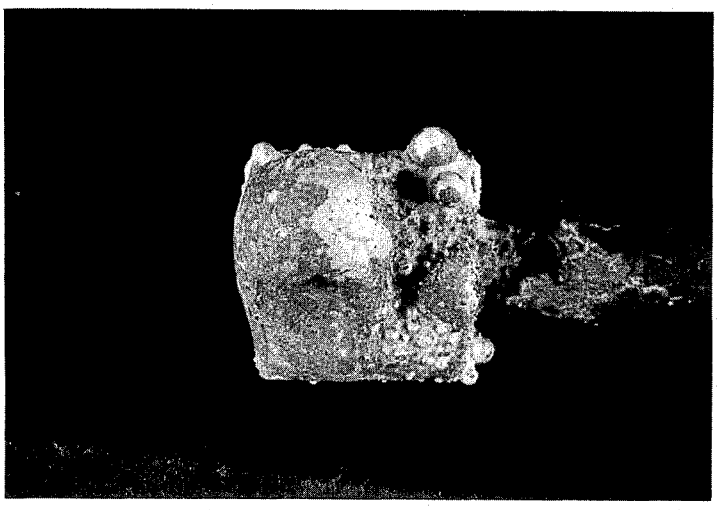
FIG. 4 CATHODE OF CARBON SUBSTRATE WITH COATING OF MO- 1 mm THICKNESS

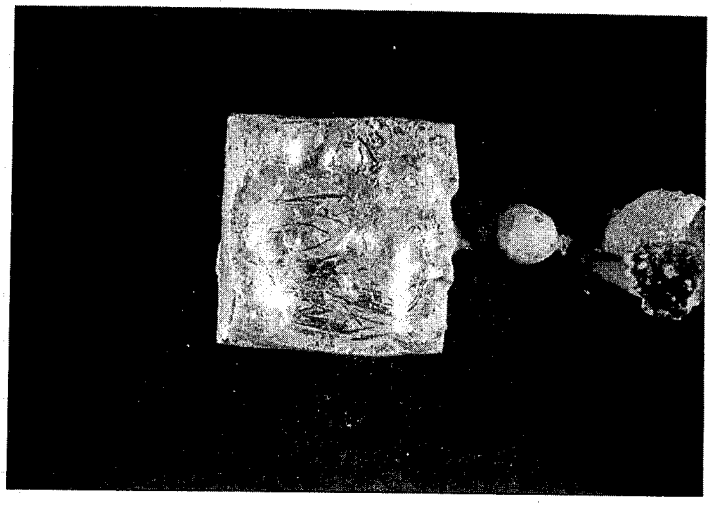
FIG. 5 CATHODE OF CARBON SUBSTRATE WITH MO-COATING 0.1 mm THICKNESS
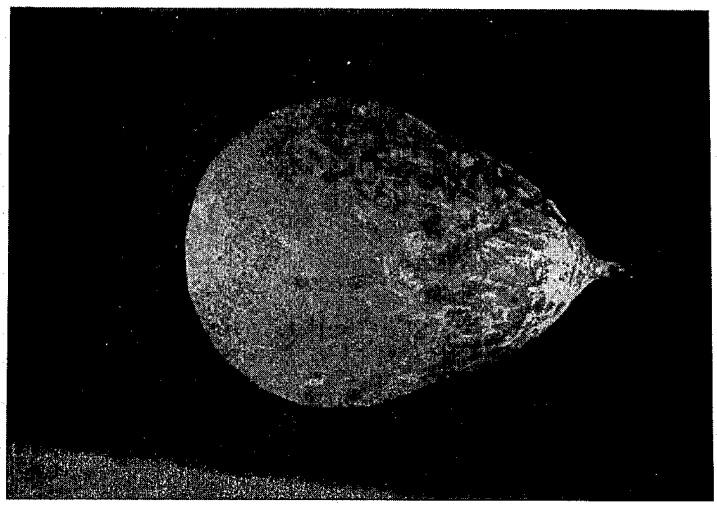
FIG.6 CATHODE OF SOLID 70% MO, 30% W

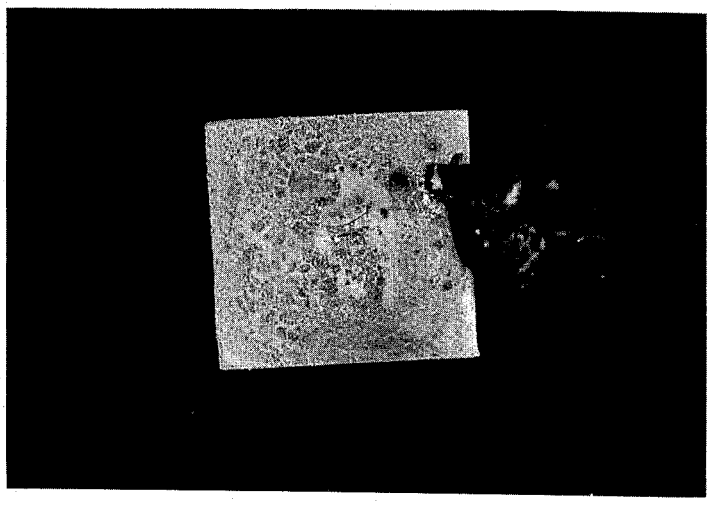
FIG. 7 CATHODE OF 99.9% W

CATHODE FOR MAGNESIUM PRODUCTION

BACKGROUND OF THE INVENTION

The present invention relates to electrodes for use in magnesium production by electrolysis of molten salts.

In electrolytical production of magnesium it is extremely important to obtain good wetting of the cathodes with the magnesium. Inferior wetting conditions result in fine droplets of metallic magnesium which easily recombine by recirculation and prolonged stay in the anode compartment. This risk decreases with increasing diameter of the metal droplets. Normally cathodes of steel are employed due to the materials stability, but unfortunately the material has poor wetting properties. By using steel cathodes the produced magnesium will be contaminated by iron due to corrosion of the cathodes. A typical content of iron in the produced metal will be in the order of 3–400 ppm.

Use of bipolar electrodes for magnesium production is also of current interest. Electrodes of this type are for example described in EPO patent No. 0,0027,016. In common use for this type of electrode, plates of iron and graphite are joined together face to face where the graphite is acting as anode and the iron acting as cathode. As with monopolar electrodes the produced magnesium will have a small content of iron. For this type of electrode it is also extremely important to have good wetting conditions between the produced metal and the cathode.

U.S. Pat. No. 4,073,704 describes a process for the production of metallic magnesium wherein a molten salt bath containing sodium chloride, magnesium chloride, potassium chloride, calcium chloride and magnesium fluoride is electrolytically decomposed. The cathodes are made of steel and the anodes of graphite. To the electrolyte there is periodically added inorganic salts of molybdenum or tungsten, metallic molybdenum or tungsten, or mixtures thereof. According to the patent this will give a coating of molybdenum or tungsten on the cathode surface. This coating is said to be less than 15 angstroms and will promote the wetting of the cathode with magnesium. Less sludge will be produced, and the sludge will also contain less magnesium.

By using the process according to U.S. Pat. No. 4,073,704 molybdenum or tungsten periodically must be added to maintain the coating, and it is difficult to control the deposition of the coating metals on the cathode. Both molybdenum and tungsten have high density, and by adding metallic Mo and W they might be precipitated in the electrolytic bath without being chlorinated and deposited at the cathode. Another disadvantage is that molybdenum and tungsten can be deposited upon already liberated magnesium, and thereby it will be removed together with the produced metal. This will contaminate the metal. By adding metal oxides of molybdenum and tungsten there will be a high content of oxides in the bath which can cause oxidation of the cathode coating and thereby make it inactive. Magnesium can also be deposited as an oxide. The cathodes thereby can be coated with an oxide if there is too much contamination in the electrolytic bath. One condition for the functioning of a process like this, is that there are few contaminants present in the electrolytic bath.

By such a process the cathodes will be unevenly and randomly coated with molybdenum and/or tungsten, and some parts of the steel surface will also be without coating from time to time.

This can lead to some corrosion of the iron which will contaminate the produced magnesium.

SUMMARY OF THE INVENTION

The object of the invention is to improve cathode wetting by magnesium in electrolytic production of magnesium and to obtain cathodes with stable wetting conditions lasting the full life of the electrolytic cell.

Another object of the invention is to reduce the contaminants of the produced metal and thereby obtain purer magnesium.

A further object of the invention is to find materials for the cathode with high cell efficiency and increased working life and which also could be used for bipolar electrodes.

These and other objects of the invention are achieved by using cathodes of solid molybdenum or tungsten or alloys of these metals or coatings of these materials on a substrate, as defined more paticularly below. Because of high material cost coated electrodes are preferably used in full scale production. The most common substrate is steel. It was however surprisingly discovered that coatings of molybdenum or tungsten or alloys thereof upon a carbon substrate also gave cathodes with excellent wetting condition. Coated carbon can also be used as the cathodic part of a bipolar electrode.

The preferred method for coating the cathodes is by flame spraying or plasma spraying. Other methods can of course be used. These coating methods have been known for years. Also the need for new cathode materials with good wetting properties has been present and known for years without this resulting in new and improved cathode products.

Experiments have shown that coatings with a thickness of 0,1 mm have excellent qualities. In full scale production we, however, found that a minimum thickness of the coating of at least 10–20 μm, preferably at least 50 μm is required to obtain stable and good wetting properties. By the use of these cathode materials the contamination of liberated magnesium with iron is avoided, and there is a minimal content of molybdenum or tungsten in the produced metal.

BRIEF DESCRIPTION OF THE DRAWINGS

Other features of the invention are described more in detail below and are also shown in the FIGS. 1–8, where FIGS. 1–7 show photos of different cathode surfaces after completed experiments. The photos are enlarged twice to better show details of the cathode surface.

DETAILED DESCRIPTION OF THE INVENTION

Figure 8:
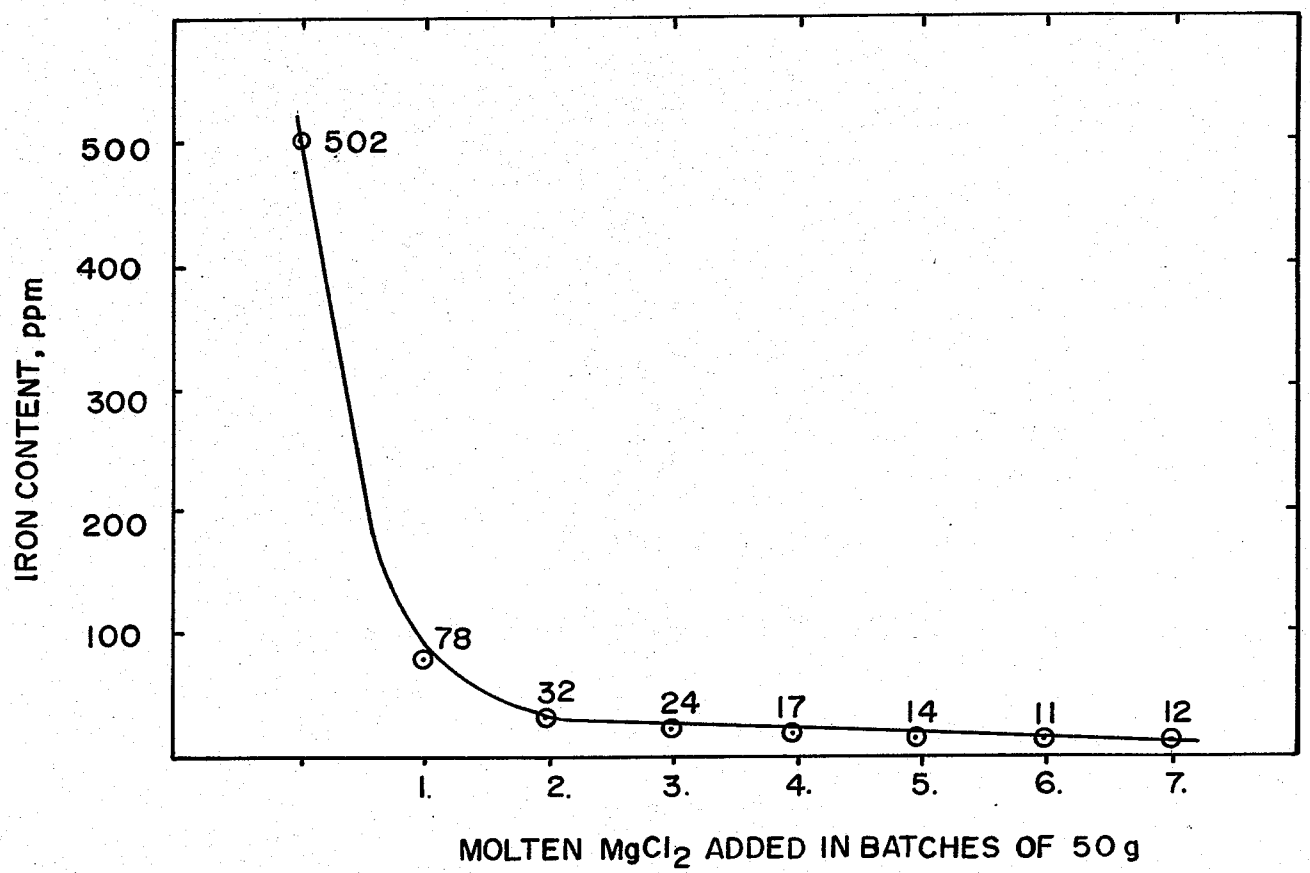
FIG. 8 shows a graph of iron content in produced magnesium.

Several experiments were carried out in order to test different cathode materials to be used for magnesium production. The experimental cell was a cylindrical container with an inner lining of quartz filled with about 600 g of $MgCl_2$ salt bath at 720° C. The cathodes of the different materials were suspended in isolated steel wires, and the anodes made of graphite were placed inside a tube of phytagoras with greater inner diameter than the anode, the tube acting as a riser for the evolved chlorine gas. This was done to prevent gas washing of the experimental cathodes. The system was closed with a cover plate and supply of nitrogen gas ensured inert atmosphere. The temperature was measured by a thermocouple.

The experiments were carried out by applying a direct current to the bath melt containing $MgCl_2$ in a range of 9–11 weight %. The electrodes could be observed through an inspection window in the container. To be able to consider the wetting conditions of the different materials, the temperature of the melt was lowered to less than 651° C. (the melting point of magnesium) resulting in "freezing" the magnnesium globules to the cathode. After the "freezing", the cathodes were taken out of the container and photographed. By studying the Mg-globules under liberation and the cathode, it is possible to get information of the wetting qualities of the different cathode materials. Before every new experiment magnesium chloride was fed to the container to maintain the concentration of $MgCl_2$. The content of contaminants in the liberated magnesium was examined in the experiments where compact cathodes were used. A full scale experiment has also been run using bipolar electrodes with Mo coating.

The coating of the cathodes was carried out by conventional flame spraying or plasma spraying. Some preliminary experiments were carried out to check the importance of pretreatment of the substrate, before coating or pretreatment of solid metal cathodes before coating. Some substrates and some solid cathodes were sandblasted before use and compared with the same type of cathodes without pretreatment. There was found very little difference in the diameter of the metal globules liberated with or without pretreatment.

The invention will now be further explained in connection with the examples which describe electrolysis experiments with different cathode materials. Cathodes of untreated steel, solid molybdenum, steel substrate with coating of molybdenum, carbon substrate with coating of Mo, solid MoW alloy and also solid tungsten cathodes have been tested.

EXAMPLE 1

To a cathode of untreated steel (ST37) there was applied a direct current of 5A for 11 hours. The cathode was then removed from the experimental cell and examined. FIG. 1 shows the appearance of the cathode. The liberated magnesium forms droplets of diameter 3–6 mm.

EXAMPLE 2

The experimental cell was filled with 500 g of a bath melt with 9% $MgCl_2$ and electrolyzed by 5A in 5 hours with a cathode of compact untreated Mo. Then 100 g of molten $MgCl_2$ was added and electrolyzed in 11 hours by 5A. The temperature of the melt was lowered and the cathode taken out of the cell and photographed as shown in FIG. 2. The active face of the cathode was in fact wholly coated by a layer of metallic magnesium, and the wetting of the cathode was excellent. The content of Mo in the liberated magnesium was less than 1 ppm.

EXAMPLE 3

Two cathodes were prepared—one with flame sprayed Mo on steel and one with plasma sprayed Mo on steel. Both coatings had a thickness of 0.35 mm. The electrolysis was run for 22 hours with 0.8 A/cm$^2$, then the temperature was lowered, the cathodes taken out and photographed. Both electrodes had, after the experiment, approximately the same appearance as shown in FIG. 3. The whole cathode face is coated with magnesium. The metal has moved up to the electrical connection, and a large globule was ready to break away from the cathode.

The thickness of the magnesium layer on the upper part of the cathode is about 5 mm. The wetting of the cathode is very good. The other face of the cathode was covered by magnesium droplets.

EXAMPLE 4

A piece of an anode stick of graphite was coated with molybdenum. Before the coating the face was sand blasted to obtain best possible adherence between the graphite face and the Mo-coating. Cathodes for the experiment were made of this piece of graphite. Flame spraying was used to coat one face of the cathodes with molybdenum. Experiments were carried out with coatings of 0.1 mm and 1 mm thickness. The electrolysis was run for 22 hours with 0.8 A/cm$^2$. The appearance of the cathodes is shown in FIGS. 4 and 5 where the first figure shows a cathode coated with 1 mm Mo and the second with 0.1 mm Mo. The photos show that the cathode surface is coated with metallic magnesium. The wetting is very good, and there are no traces of metal on the graphite face. There is no visible difference of the magnesium liberation on cathodes with coating of 0.1 mm and 1 mm.

EXAMPLE 5

Experiments were carried out with magnesium liberation on a cathode of Moly B60-alloy (70% Mo, 30% W, Metallwerk Plansee GmbH). The cathode used was a circular disc of 30 mm diameter, and the electrolysis was run with 0.8 A/cm$^2$ for 22 hours. FIG. 6 shows the appearance of the cathode after "freezing" of the metal. As shown on the photo the cathode has been drop-shaped because the magnesium has risen up to and above the electrical connection. The thickness of the metal layer in the upper part is about 7 mm. The wetting is especially good. The back face of the cathode has the same appearance as the front face.

EXAMPLE 6

A cathode of 99.9% W was used in electrolysis with 0.8 A/cm$^2$ in 11 hours. FIG. 7 shows the appearance of the cathode after completed experiment. The whole active cathode face is coated with magnesium. The thickness of the metal layer increases gradually from the edge to about 5 mm in the center of the cathode face. The wetting is very good. The back face of the cathode has about the same appearance, but not so much metal liberated. Analysis of the produced magnesium gave a content of 0.7 ppm tungsten.

EXAMPLE 7

The experiment was carried out to find the lowest limit for the iron content in metallic magnesium produced with a plasma sprayed Mo-cathode and by the use of molten $MgCl_2$-feed. The molten electrolyte (500 g) containing 10% Mg $Cl_2$ was first run empty of $MgCl_2$ by 5A in 5½ hours. All liberated magnesium was removed for analysis of Fe. Then seven charges each of 50 g molten $MgCl_2$ followed with electrolysis of the melt until all $MgCl_2$ was used and removing of the produced metal between the charges. The results from the analyses of the produced metal are shown on a graph in FIG. 8. As shown by the graph the analysis of the metal after the first run showed an iron content of 502 ppm. Already after the first feed of molten $MgCl_2$ the content of Fe is reduced to 78 ppm, and after further six additions and runs the iron content was stabilized to about 11–12 ppm.

EXAMPLE 8

A full scale experiment was run using bipolar electrodes in electrolytic cells for magnesium production. A coating of 1 mm molydenum on a substrate of graphite was used. The average current density was 4000 $A/m^2$.

Surprisingly, the cathodes in the ordinary electrolytic cells did behave differently from the cathodes in the experimental cell. By starting up the experiment it was accidentally observed that some of the Mo-coating did dissolve in the melt. This appeared as a faint green colour which disappeared after 2–3 days. Analysis of samples from the melt taken the third day showed a content of 2.5 ppm Mo in the melt. This did stabilize on an average of 0.48 ppm Mo after about 4 days. Analysis of the metal showed 11 ppm Mo the first days. After about 4 days the content of Mo in the metal was stable at an average of 1.2 ppm Mo. The wetting properties of these cathodes were as good as those used in the experimental cell.

These results show that by choosing the thickness of the Mo or W-coating it must be taken into consideration that a certain amount of the coating will dissolve into the melt and the produced metal.

The results from these experiments thus make it possible to calculate the minimum required thickness of the coating.

With a current density of 5000 $A/m^2$ and current efficiency of 85%, the produced metal p per 24 hours will be:

$$p = \frac{A}{n \cdot F} \cdot I \cdot t = \frac{24.3 \cdot 5000 \cdot 24}{2 \cdot 26.8} \cdot 0.85 = 46.24 \text{ kg Mg/m}^2$$

A=atomic weight
n=valency
F=Faraday constant, Ah
I=current, A
t=time, h

This equals 16878 kg $Mg/m^2$ per year.

With an average of 1.2 ppm Mo in the produced metal, this will give a yearly consumption of Then it is interesting to find the corresponding thickness of the coating.

$$\rho Mo = 10.2 \text{ g/cm}^3$$

$$VMo = \frac{20 \text{ g}}{10.2 \text{ g/cm}^2} = 1.96 \text{ cm}^3 = 1.96 \cdot 10^{-6} \text{ m}^3$$

$$\text{Thickness: } \frac{1.96 \cdot 10^{-6} \text{ m}^3}{1 \text{ m}^2} = 1.96 \cdot 10^{-6} \text{ m} \approx 2 \ \mu\text{m}$$

As the average lifetime for the cathodes until now has been 5–10 years, the minimum required theoretical thickness will be 10–20 μm. With this thickness it is provided that the coating is smooth and that the wear and tear is uniform over the whole surface.

A practical thickness of the coating should however be in the order of at least 50 μm to obtain the beneficial results according to the invention with the present coating techniques available.

As a comparison to the U.S. Pat. No. 4,073,704 where 15 Å was said to be a sufficient coating of the electrodes, the minimum theoretical coating which represents the wear and tear in one day and night will be nearly four times as high, i.e. 55 Å.

According to the invention we have found that plasma- or flame sprayed Mo-coatings on steel have very good wetting properties as cathode for electrolytic magnesium production. The same result is obtained with flame sprayed Mo-coatings on graphite. Uncoated graphite has bad wetting conditions.

Compact molybdenum, an alloy of 70% Mo and 30% W, and compact tungsten have very good wetting properties and especially use of the alloys leads to excellent results. The metallic magnesium forms a surfacing layer on the cathode face, and this will increase the recovery of magnesium. Under the same conditions the metal liberation on a steel cathode will be in the shape of droplets with diameter 3–6 mm.

There is no difference between wetting properties of cathodes of compact metal, and cathodes with coatings. By use of electrodes of this type the content of iron in the produced metal will be reduced to around 10 ppm.

We claim:

1. An electrolytic cell for production of magnesium by electrolysis of a magnesium salt melt, said cell comprising a molten magnesium salt, an anode and a cathode, wherein the cathode consists of a substrate coated with molybdenum, tungsten or an alloy of these metals, and wherein the coating has a thickness of at least 10 μm.

2. The electrolytic cell according to claim 1, wherein the coating has a thickness of at least 50 μm.

3. The electrolytic cell according to claim 1, wherein the substrate consists of steel.

4. The electrolytic cell according to claim 1, wherein the substrate consists of carbon.

5. The electrolytic cell according to claim 1, wherein the coating consists of about 70% Mo and 30% W.

6. An electrolytic cell comprising an anode, a cathode and one or more intermediate bipolar electrodes, for production of magnesium metal by electrolysis of a salt melt, wherein the bipolar electrode consists of a carbon plate with a coating of molybdenum, tungsten or an alloy of these metals on one face of the carbon plate, and wherein the coated face constitutes the cathodic face of the electrode.

7. The electrolytic cell according to claim 6, wherein the coating has a thickness of at least 10 μm.

8. The electrolytic cell according to claim 6, wherein the coating has a thickness of at least 50 μm.

9. The electrolytic cell according to claim 6, wherein the coating consists of about 70% Mo and 30% W.

* * * * *